US012007120B2

(12) United States Patent
Bianchi et al.

(10) Patent No.: US 12,007,120 B2
(45) Date of Patent: Jun. 11, 2024

(54) REMOVABLE BOTTOM TRIM

(71) Applicant: WHIRLPOOL CORPORATION, Benton Harbor, MI (US)

(72) Inventors: Fabio Bianchi, Ranco (IT); Elisabetta Bressan, Varese (IT)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 144 days.

(21) Appl. No.: 17/555,603

(22) Filed: Dec. 20, 2021

(65) Prior Publication Data

US 2023/0194102 A1 Jun. 22, 2023

(51) Int. Cl.
*F24C 15/00* (2006.01)

(52) U.S. Cl.
CPC ..... *F24C 15/007* (2013.01)

(58) Field of Classification Search
CPC ..... F24C 15/007
See application file for complete search history.

(56) References Cited

U.S. PATENT DOCUMENTS

| | | | | |
|---|---|---|---|---|
| 2,062,814 | A * | 12/1936 | Kramer | F24C 15/14 126/337 R |
| 2,796,060 | A * | 6/1957 | Binns | F24C 3/027 126/39 BA |
| 3,529,582 | A * | 9/1970 | Bohdan | F24C 15/325 219/400 |
| 3,882,767 | A * | 5/1975 | Oyler | A21B 1/24 126/21 R |
| 5,286,940 | A | 2/1994 | Leeds | |
| 6,166,353 | A | 12/2000 | Senneville et al. | |
| 8,079,652 | B2 | 12/2011 | Laible et al. | |
| 8,813,328 | B2 | 8/2014 | Avila et al. | |
| 10,030,874 | B2 * | 7/2018 | Stuhrmann | F24C 15/08 |
| 2020/0300477 | A1 | 9/2020 | Dinkel et al. | |
| 2021/0325047 | A1 * | 10/2021 | Lieftink | F24B 15/04 |
| 2023/0105085 | A1 * | 4/2023 | Pugel | F24C 15/08 126/19 R |

FOREIGN PATENT DOCUMENTS

| | | |
|---|---|---|
| DE | 2653779 | 6/1978 |
| DE | 19708739 | 9/1998 |
| DE | 19907234 | 8/2000 |
| DE | 102004020181 | 11/2005 |
| EP | 2458288 | 5/2012 |

* cited by examiner

*Primary Examiner* — David J Laux
(74) *Attorney, Agent, or Firm* — PRICE HENEVELD LLP

(57) ABSTRACT

An oven assembly includes a cooking chamber having a rear wall, a pair of opposed side walls, a top wall, a bottom wall, and an access opening defined by an outer perimeter of the cooking chamber. A movable door operably is coupled with the oven assembly for selectively enclosing the cooking chamber about the outer edge of the cooking chamber. A removable bottom trim panel is disposed proximate a bottom edge of the outer perimeter and includes a tray body. A removable fastening mechanism is disposed on the tray body or the bottom edge and operably couples the tray body to the bottom edge, such that the removable fastening mechanism is adapted to removably attach the removable bottom trim panel to the bottom edge.

20 Claims, 7 Drawing Sheets

REMOVABLE BOTTOM TRIM

BACKGROUND OF THE DISCLOSURE

The present disclosure generally relates to an oven assembly for cooking food items, and more specifically, to an oven assembly having a removable bottom trim panel proximate a bottom edge of the oven opening to facilitate cleaning.

SUMMARY OF THE DISCLOSURE

According to one aspect of the present disclosure, an oven assembly includes a cooking chamber having a rear wall, a pair of opposed side walls, a top wall, a bottom wall, and an access opening defined by an outer perimeter of the cooking chamber. A movable door operably is coupled with the oven assembly for selectively enclosing the cooking chamber about the outer perimeter of the cooking chamber. A removable bottom trim panel is disposed proximate a bottom edge of the outer perimeter and includes a tray body. A removable fastening mechanism is disposed on the tray body or the bottom edge and operably couples the tray body to the bottom edge, such that the removable fastening mechanism is adapted to removably attach the removable bottom trim panel to the bottom edge.

Further features of this aspect of the present disclosure include the removable fastening mechanism may comprise a plurality of hooks disposed on the removable bottom trim panel adapted to engage a plurality of apertures disposed on the bottom edge or a plurality of hooks disposed on the bottom edge adapted to engage a plurality of apertures on the removable bottom trim panel. The bottom edge comprises the plurality of apertures horizontally arranged at separated intervals along the bottom edge and the removable fastening mechanism comprises the plurality of hooks arranged at separated intervals along a longitudinal edge of the tray body. The plurality of apertures horizontally arranged at separated intervals are aligned with the plurality of hooks arranged at separated intervals along the longitudinal edge of the tray body. The removable fastening mechanism comprises a plurality of offset tabs disposed on the removable bottom trim panel adapted to engage a plurality of apertures disposed on the bottom edge or a plurality of offset tabs disposed on the bottom edge adapted to engage a plurality of apertures on the removable bottom trim panel. A hook disposed on the removable bottom trim panel or the bottom edge. The hook is disposed between the plurality of offset tabs. The bottom edge comprises a plurality of apertures horizontally arranged at separated intervals along the bottom edge and the removable fastening mechanism comprises a plurality of offset tabs arranged at separated intervals along a longitudinal edge of the tray body, wherein the plurality of apertures horizontally arranged at separated intervals along the bottom edge are aligned with the plurality of offset tabs arranged at separated intervals along the longitudinal edge of the tray body. The removable fastening mechanism further comprises a hook arranged along the longitudinal edge of the tray body and disposed between the plurality of offset tabs, and one of the plurality of apertures horizontally arranged at separated intervals of the bottom edge aligns with the hook arranged along the longitudinal edge of the tray body. The removable fastening mechanism comprises a plurality of aligned magnets arranged at separated intervals along a flange disposed along a longitudinal edge of the tray body or along the bottom edge, where the bottom edge comprises a front frame emboss disposed along the bottom edge and the plurality of magnets are arranged at separated intervals along the flange disposed along a longitudinal edge of the tray body and where the front frame emboss comprises a first side corner and a second side corner and one of the plurality of aligned magnets at a first side of the tray body is disposed to engage the first side corner and another of the plurality of aligned magnets at an opposite second side of the tray body is disposed to engage the second side corner. The front frame emboss comprises a longitudinal recess defined by the first side corner and the second side corner and a trough extending between the first side corner and the second side corner, where the plurality of aligned magnets are disposed upon a bottom side of the flange disposed along the longitudinal edge of the tray body and extend into and are received within the longitudinal recess. The removable bottom trim panel further comprises a mounting flange extending from and disposed parallel with a longitudinal length of the tray body and upon which the removable fastening mechanism is disposed, and where the tray body comprises a front wall and a pair of opposed end walls, and the mounting flange further comprises a pair of opposed side walls being received within, and the removable bottom trim panel being located by, a pair of opposed side edges of the outer perimeter of the cooking chamber.

According to another aspect of the present disclosure, a removable bottom trim panel for an oven assembly is disclose, wherein a bottom edge of an opening of a cooking chamber of the oven is disposed proximate an oven door. The removable bottom trim panel includes a tray body having a front wall and a pair of opposed side walls. A flange is operably coupled with the tray body opposite the front wall and extending from and disposed parallel with a longitudinal length of the tray body. A removable fastening mechanism disposed on the flange and adapted to engage the bottom edge or disposed on the bottom edge and adapted to engage the flange.

Further features of this aspect of the present disclosure include the removable fastening mechanism comprises a plurality of hooks disposed on the flange and adapted to engage a plurality of aligned apertures disposed on the bottom edge. The removable fastening mechanism further comprises a plurality of offset tabs disposed on the flange and adapted to engage a plurality of aligned apertures disposed on the bottom edge. The removable fastening mechanism further comprises a hook disposed between the plurality of offset tabs and adapted to engage a one of the plurality of aligned apertures disposed on the bottom edge. The removable fastening mechanism further comprises a plurality of magnets arranged at separated intervals along the flange and adapted to engage the bottom edge. The bottom edge further comprises a front frame emboss having a longitudinal recess defined by a first side corner and a second side corner and a trough extending between the first side corner and the second side corner, and the plurality of magnets are disposed upon a bottom side of the flange disposed along a longitudinal edge of the tray body and extend into and are received within the longitudinal recess.

According to yet another aspect of the present disclosure, an oven assembly comprises a cooking chamber having a bottom edge partially defining an opening of the cooking chamber. A removable bottom trim panel is disposed proximate the bottom edge. The removable bottom trim panel includes a tray body having a front wall, a pair of opposed end walls, and a flange having a pair of opposed side walls operably coupled with the tray body opposite the front wall and extending from and disposed parallel with a longitudinal length of the tray body. A removable fastening mechanism is disposed on the flange and is adapted to engage the bottom edge of the opening of the cooking chamber.

Further features of this aspect of the present disclosure include the opening of the cooking chamber further comprises a pair of opposed side edges, and wherein the opposed side walls of the flange of the tray body are received within and the removable bottom trim panel is located by the pair of opposed side edges of the cooking chamber.

These and other features, advantages, and objects of the present disclosure will be further understood and appreciated by those skilled in the art by reference to the following specification, claims, and appended drawings.

Figure 1:
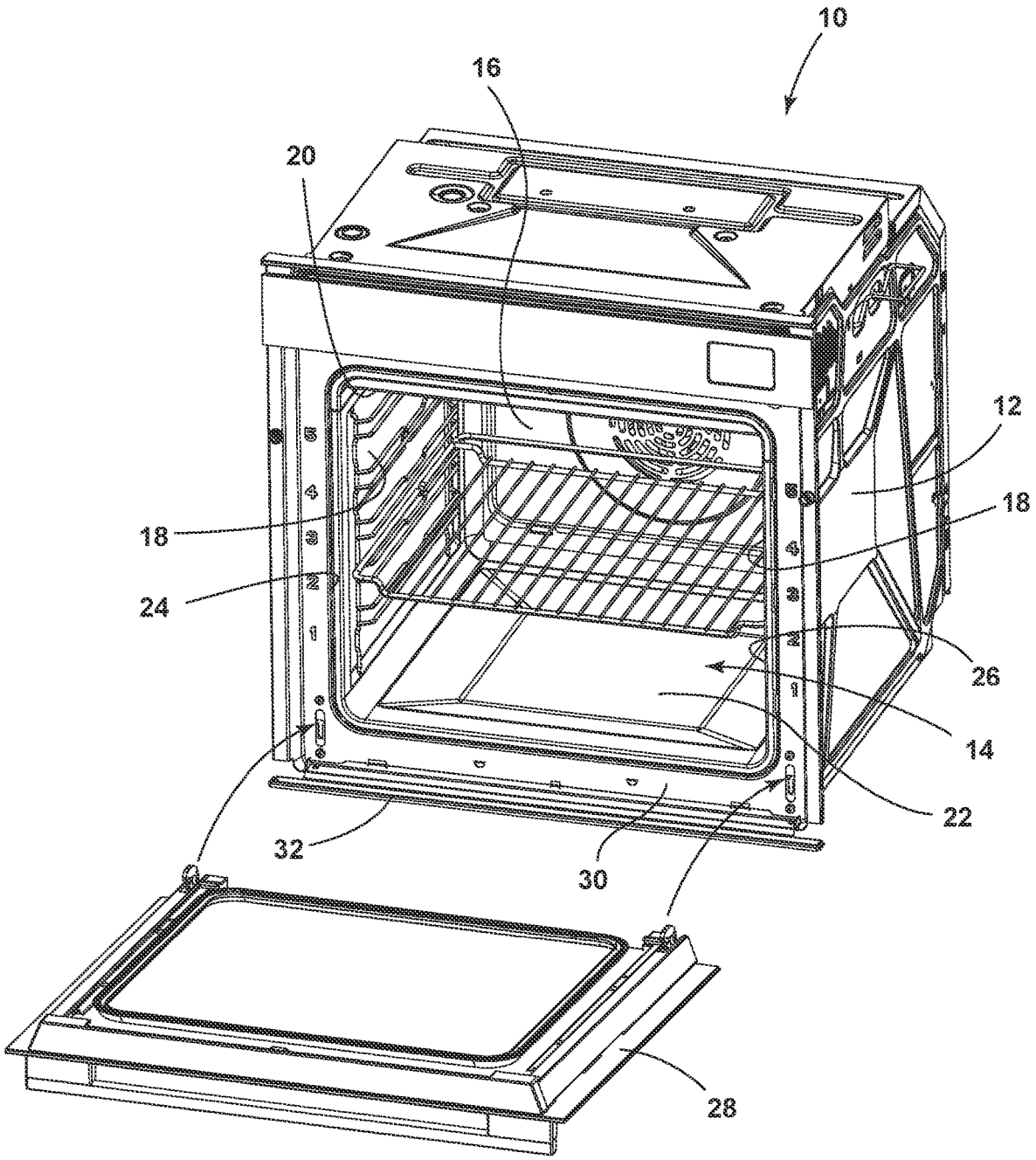
FIG. 1 is a perspective view of the oven assembly according to the present disclosure.

The components in the Figures are not necessarily to scale, emphasis instead being placed upon illustrating the principles described herein.

DETAILED DESCRIPTION

The present illustrated embodiments reside primarily in combinations of method steps and apparatus components related to an oven assembly having a removable bottom trim panel is disposed proximate a bottom edge of the outer perimeter of the opening for the oven assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With reference to FIGS. 1-6, the present disclosure provides an oven assembly 10 that includes a body 12 the defines a cooking chamber 14 having a rear wall 16, a pair of opposed side walls 18, a top wall 20, a bottom wall 22, and an access opening 24 defined by an outer perimeter 26 of the cooking chamber 14. A movable oven door 28 is operably coupled with the oven assembly 10 for selectively enclosing the cooking chamber 14 about the outer perimeter 26 of the cooking chamber 14. The movable oven door 28 may also be removable, as shown in FIG. 1. As shown, the movable oven door 28 may be pivotally mounted proximate a bottom edge 30 of the outer perimeter 26 of the access opening 24. However, other door configurations may be employed.

A removable bottom trim panel 32 is disposed proximate the bottom edge 30 of the outer perimeter 26. The removable bottom trim panel 32 may extend substantially across the width of the access opening 24 and may include a longitudinally extending tray body 34. The tray body 34 may likewise extend across the width of the access opening 24, and may extend even further from side to side than the removable bottom trim panel 32, as perhaps best shown in FIG. 2. The removable bottom trim panel 32 may be fabricated from metal, such as stamped steel sheet metal, or may be injection molded from a polymeric material.

Figure 3:
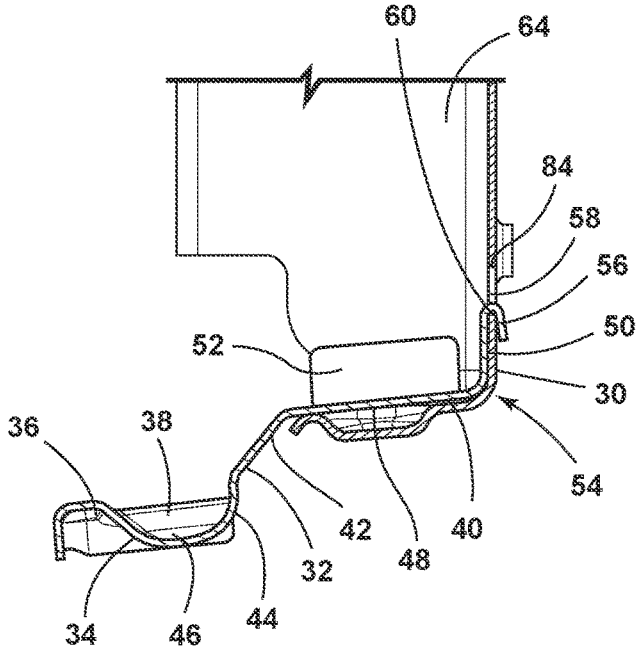
FIG. 3 is an cross-sectional view of the portion of the oven assembly shown in FIG. 1 and the first embodiment of the removable bottom trim panel according to the present disclosure, taken along the line III-Ill in FIG. 2.

The tray body 34 may include a front wall 36, a pair of opposed end walls 38, and a flange 40 operably coupled with the tray body 34 opposite the front wall 36 and extending from and disposed parallel with a longitudinal length of the tray body 34. As shown in FIG. 3, a forward portion 42 of the flange 40 also forms a rear wall 44 of the tray body, thus defining a channel 46 within which crumbs and other debris that may collect on the tray body 34 may be contained. The flange 40 may include a rearward portion 48 defining a generally horizontally planar surface and a upwardly extending rear longitudinal edge 50. The flange 40 may also include a pair of opposed side walls 52.

As shown in FIGS. 1-6, a first embodiment of a removable fastening mechanism 54 may be disposed on the tray body 34 of the removable bottom trim panel 32, whereby the removable fastening mechanism 54 is adapted to removably attach the removable bottom trim panel 32 to the bottom edge 30 of the oven assembly 10. The removable fastening mechanism 54 may be coupled to the tray body 34 of the removable bottom trim panel 32 via the flange 40 of the removable bottom trim panel 32. The removable fastening mechanism 54 extends from the flange 40 toward the body 12 of the oven assembly 10.

As illustrated in FIGS. 3-6, the first embodiment of the removable fastening mechanism 54 is depicted as consisting of a plurality of downwardly directed hooks 56 horizontally arranged at separated intervals along the rear longitudinal edge 50 of the removable bottom trim panel 32. The bottom edge 30 of the oven assembly 10 may include a plurality of apertures 58 horizontally arranged at separated intervals along the bottom edge 30. The plurality of apertures 58 horizontally arranged at separated intervals along the bottom edge 30 are aligned with the plurality of hooks 56 arranged at separated intervals along the longitudinal edge of the tray body 34. Thus, each of the plurality of hooks 56 may be adapted to engage a lower edge 60 of the plurality of apertures 58 disposed on the bottom edge 30 of the oven assembly 10.

Figure 4:
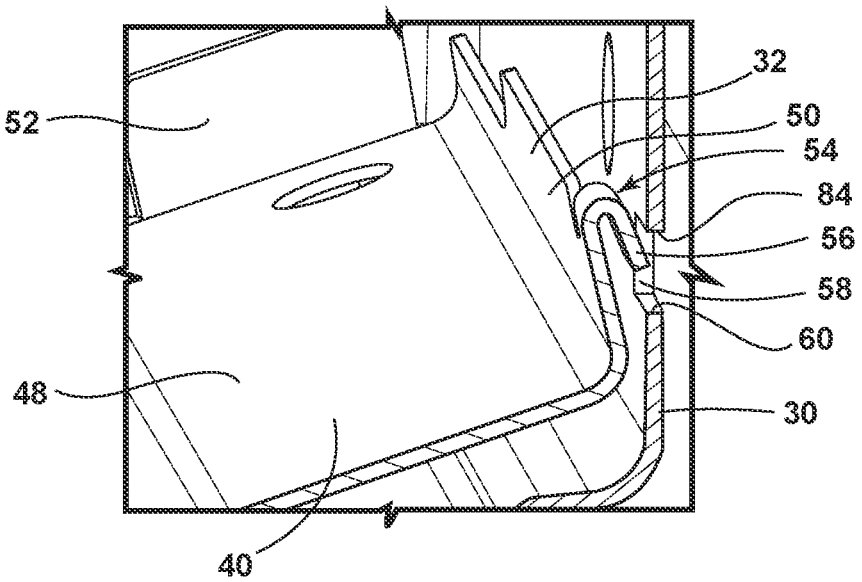
FIG. 4 is an cross-sectional perspective view of the portion of the oven assembly shown in FIG. 1 and the first embodiment of the removable bottom trim panel according to the present disclosure, again taken along the line III-Ill in FIG. 2.
Figure 5:
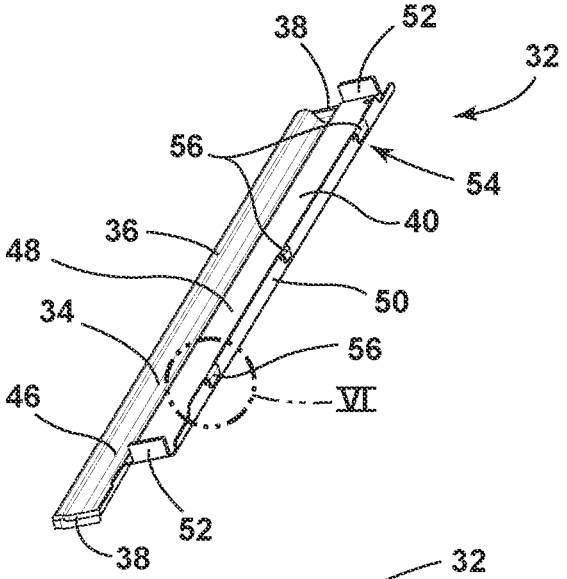
FIG. 5 is a is a perspective view of the first embodiment of the removable bottom trim panel according to the present disclosure.
Figure 6:
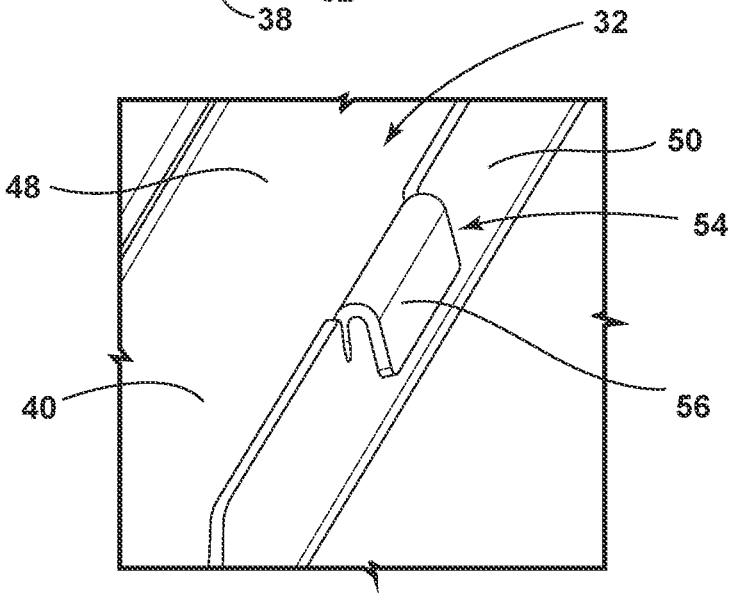
FIG. 6 is an enlarged perspective view of a portion of the first embodiment of the removable bottom trim panel according to the present disclosure shown in FIG. 5.

That is, the hooks 56 can be positioned within the plurality of apertures 58 to operably couple the removable bottom trim panel 32 to the oven assembly 10. As shown in FIG. 4, the vertical height of each of the plurality of apertures 58 may be sized to accept each of the plurality of hooks 56 being inserted into the plurality of apertures 58 when the removable bottom trim panel 32 is slightly raised and inserted into the access opening 24, after which the removable bottom trim panel 32 may be lowered. As shown in FIGS. 3, 5, and 6, once the plurality of hooks 56 are lowered and seated on the lower edges 60 of the plurality of apertures 58, the removable bottom trim panel 32 may sit proximate to or upon the bottom edge 30 of the oven assembly 10, where the plurality of hooks 56 positively and removably couple the removable bottom trim panel 32 to the bottom edge 30 of the oven assembly 10. In order to remove the removable bottom trim panel 32, the removable bottom trim panel 32 may be simply raised so that the plurality of hooks 56 clear the plurality of apertures 58 and the removable bottom trim panel 32 may be withdrawn from the access opening 24.

Additionally or alternatively, a second embodiment of the removable fastening mechanism 54 is illustrated in FIGS. 7-10, and may include first and second upwardly directed offset tabs 62 and a single downwardly directed hook 56. The hook 56 may be disposed in a center position between the plurality of offset tabs 62. The offset tabs 62 are configured to slide upwardly within the plurality of apertures 58 on the bottom edge 30, while the hook 56 is disposed within one of the plurality of apertures 58 as described above.

Figure 9:
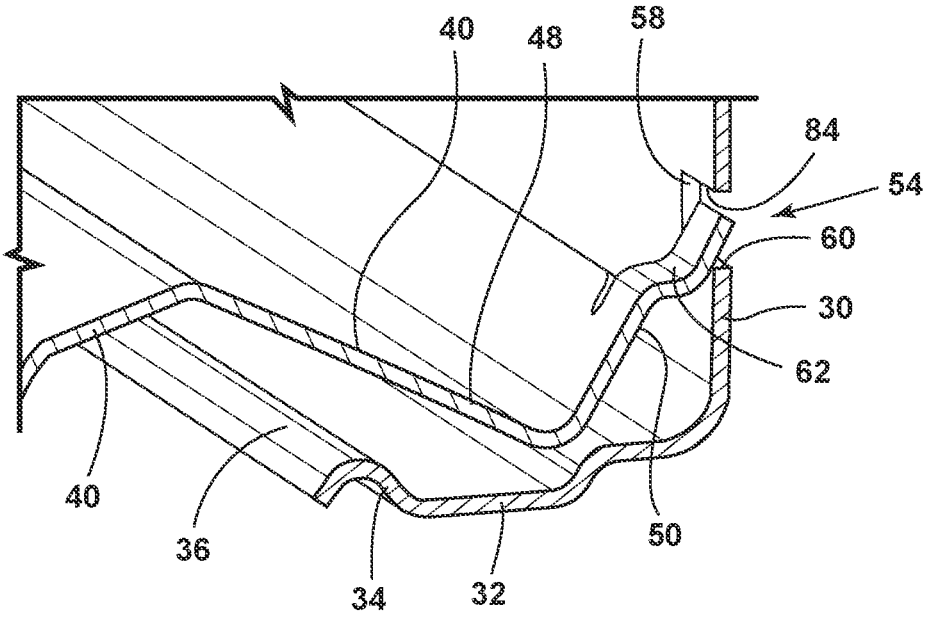
FIG. 9 is an cross-sectional perspective view of the portion of the second embodiment of the removable bottom trim panel according to the present disclosure shown in FIG. 7, again taken along the line VIII-VIII in FIG. 7.
Figure 10:
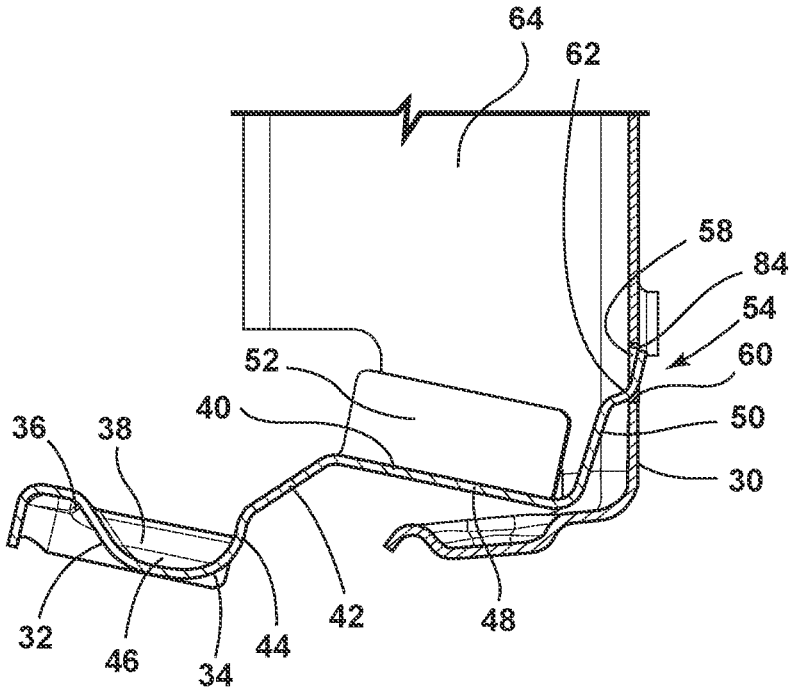
FIG. 10 is an cross-sectional view of the portion of the oven assembly and the second embodiment of the removable bottom trim panel according to the present disclosure shown in FIG. 7, taken along the line VIII-VIII in FIG. 7.
Figure 11:
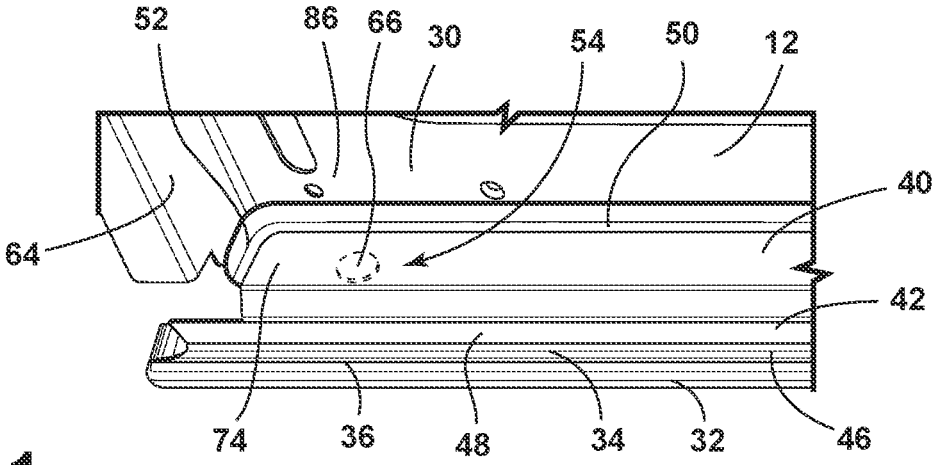
FIG. 11 is an enlarged perspective view of a portion of the oven assembly shown in FIG. 1 and a third embodiment of the removable bottom trim panel according to the present disclosure.

Again, the plurality of apertures 58 may be sized to accept the offset tabs 62 being inserted into the plurality of apertures 58 from below when the front wall 36 of the removable bottom trim panel 32 is raised and the removable bottom trim panel 32 is tilted, as shown in FIGS. 9 and 10. Once the offset tabs 62 are received within the plurality of apertures 58, the removable bottom trim panel 32 may then be slightly raised and the hook 56 may be inserted into the remaining central aperture 58, after which the removable bottom trim panel 32 may be lowered. Again, once seated, the removable bottom trim panel 32 is released to sit proximate to or upon the bottom edge 30 of the oven assembly 10 and the offset tabs 62 and hook 56 positively and removably couple the removable bottom trim panel 32 to the bottom edge 30 of the oven assembly 10. In order to remove the removable bottom trim panel 32, the installation process is simply reversed. The dual engagement of the offset tabs 62 and the hook 56 assist in maximizing the stability of the removable bottom trim panel once 32 coupled to the oven assembly 10.

Figure 2:
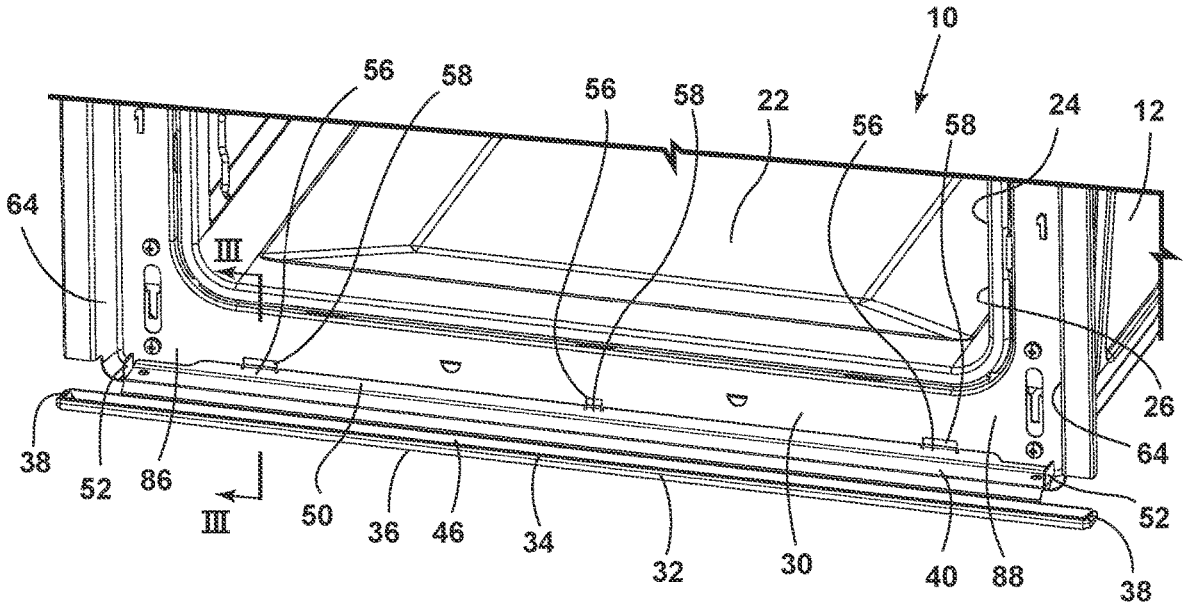
FIG. 2 is an enlarged perspective view of a portion of the oven assembly shown in FIG. 1 and a first embodiment of the removable bottom trim panel according to the present disclosure.
Figure 7:
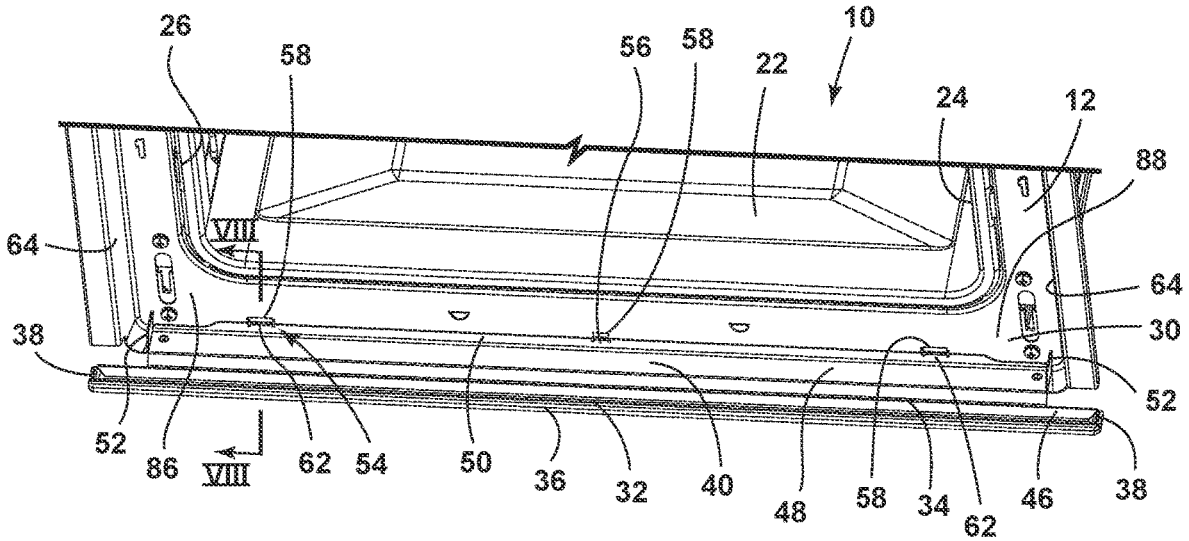
FIG. 7 is an enlarged perspective view of a portion of the oven assembly shown in FIG. 1 and a second embodiment of the removable bottom trim panel according to the present disclosure.
Figure 8:
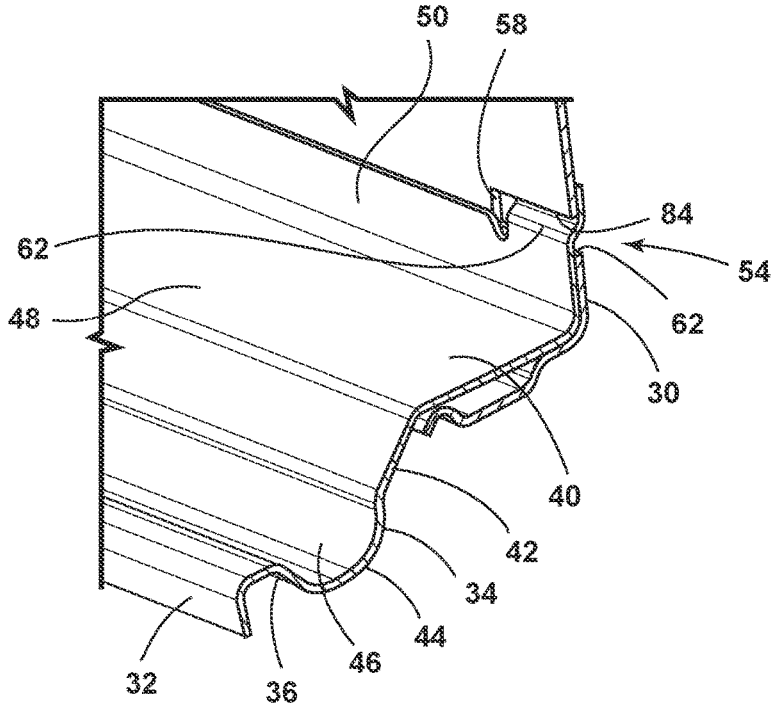
FIG. 8 is an cross-sectional perspective view of the portion of the oven assembly shown in FIG. 1 and the second embodiment of the removable bottom trim panel according to the present disclosure shown in FIG. 7, taken along the line VIII-VIII in FIG. 7.

As shown in FIGS. 2 and 7, the opposed side walls 52 of the flange 40 may be received within, and the removable bottom trim panel 32 may thus be located by, a pair of opposed side edges 64 of the outer perimeter 26 of the cooking chamber 14. That is, the side walls 52 engage with the body 12 of the oven assembly 10 when a user is aligning the removable bottom trim panel 32 with the oven assembly 10. The assisted alignment by the side walls 52 may assist the user to properly align the removable fastening mechanism 54 with the plurality of apertures 58. Stated differently, the side walls 52 provide a guide that assists the user in properly aligning the removable bottom trim panel 32 with the oven assembly 10 during installation.

Figure 12:
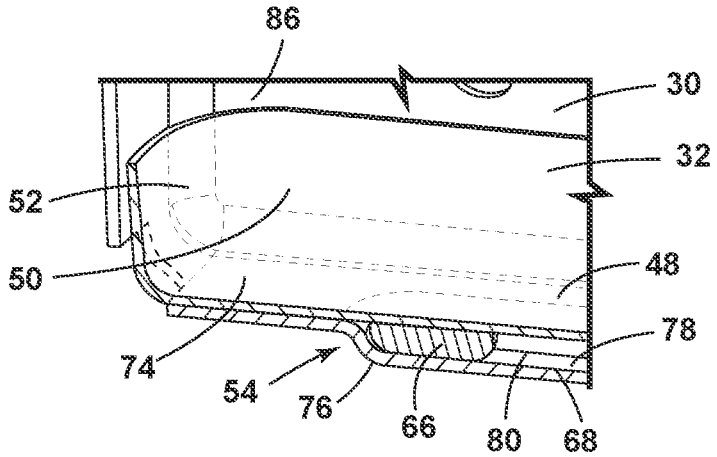
FIG. 12 is an cross-sectional perspective view of the portion of the oven assembly and the third embodiment of the removable bottom trim panel according to the present disclosure shown in FIG. 11.
Figure 13:
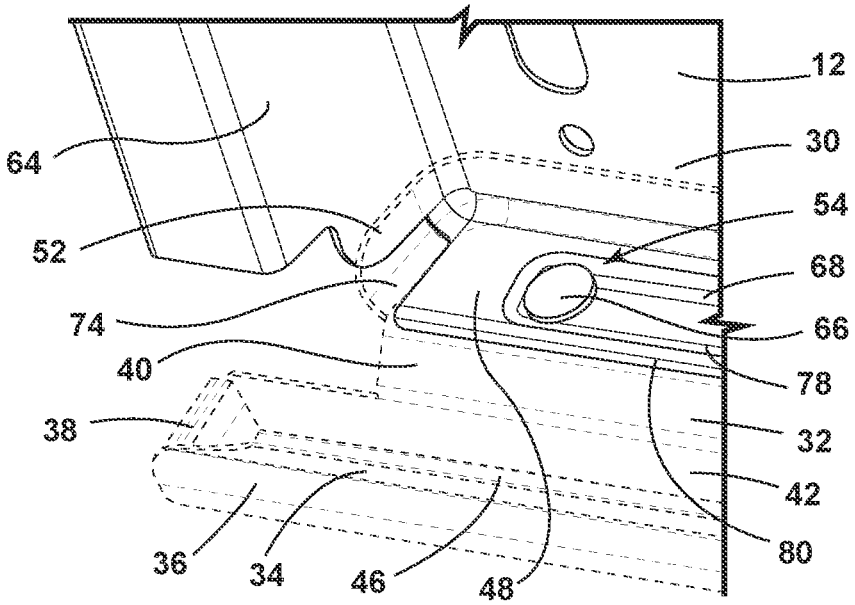
FIG. 13 is a perspective view of the portion of the oven assembly and the third embodiment of the removable bottom trim panel according to the present disclosure shown in FIG. 11, with the removable bottom trim panel (except for the removable fastening mechanism) shown in phantom.
Figure 14:
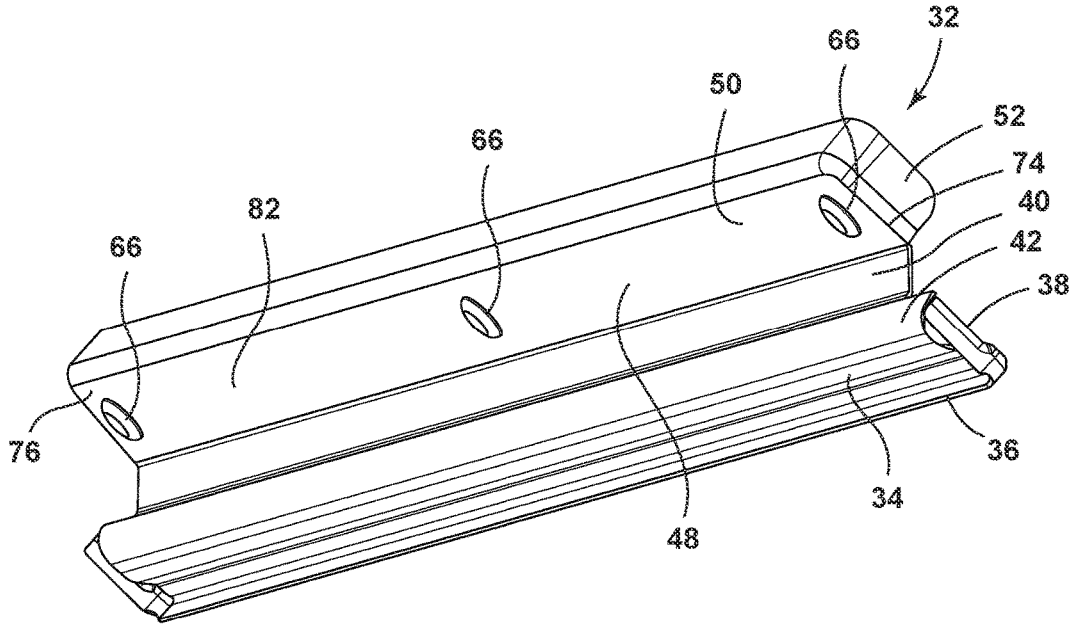
FIG. 14 is a perspective bottom view of the third embodiment of the removable bottom trim panel according to the present disclosure shown in FIG. 11.
Figure 15:
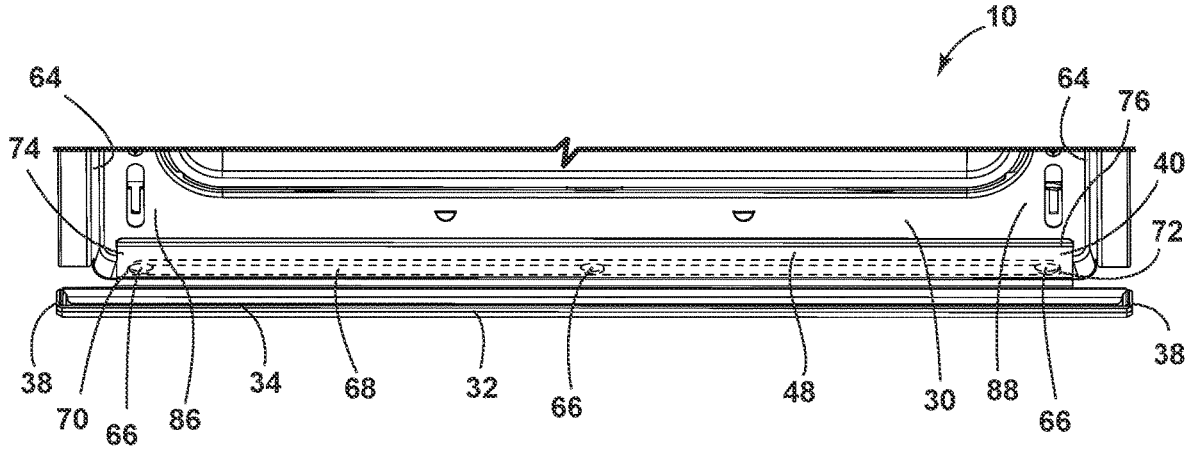
FIG. 15 is an perspective view of a portion of the oven assembly shown in FIG. 1 and the third embodiment of the removable bottom trim panel according to the present disclosure shown in FIG. 11.

Additionally or alternatively, a third embodiment of the removable fastening mechanism 54 is illustrated in FIGS. 11-15, and may include a plurality of aligned magnets 66 arranged at separated intervals along the flange 40 disposed along the rear longitudinal edge 50 of the tray body 34. As shown in FIGS. 12 and 13, the bottom edge 30 may be fabricated from steel or other ferrous material and may include a front frame emboss 68 disposed along the bottom edge 30. The front frame emboss 68 may also include a first side corner 70 and a second side corner 72, such that one of the plurality of aligned magnets 66 at a first side 74 of the tray body 34 is disposed to engage the first side corner 70 and another of the plurality of aligned magnets 66 at an opposite second side 76 of the tray body 34 is disposed to engage the second side corner 72, as shown in FIG. 12. The front frame emboss 68 may further include a longitudinal recess 78 defined by the first side corner 70 and the second side corner 72 and a trough 80 extending between the first side corner 70 and the second side corner 72. The plurality of aligned magnets 66 may be disposed upon a bottom side 82 of the flange 40, as shown in FIG. 14, and may extend into and be received within the longitudinal recess 78, as shown in FIGS. 11-13 and 15. The longitudinal recess 78 and the magnets 66 on the extreme sides of the tray body 34 assist the user in properly aligning the removable bottom trim panel 32 with the oven assembly 10 during installation.

Thus, the removable fastening mechanism 54 of the present disclosure may include a plurality of hooks 56 disposed on the flange 40 and adapted to engage a plurality of aligned apertures 58 disposed on the bottom edge 30. The removable fastening mechanism 54 of the present disclosure may include a plurality of offset tabs 62 disposed on the flange 40 and adapted to engage a plurality of aligned apertures 58 disposed on the bottom edge 30. The removable fastening mechanism 54 may also include a hook 56 disposed between the plurality of offset tabs 62 and adapted to engage a one of the plurality of aligned apertures 58 disposed on the bottom edge 30. The removable fastening mechanism 54 further may include a plurality of magnets 66 arranged at separated intervals along the flange and adapted to engage the bottom edge 30.

Alternatively, it should be understood that the embodiments of the removable fastening mechanism 54 described above may be reversed. That is, in the case of the first embodiment, the plurality of hooks 56 may be oriented upward and may be disposed on the bottom edge 30 of the oven assembly 10, with the corresponding plurality of apertures 58 disposed on the upwardly extending rear longitudinal edge 50 of the removable bottom trim panel 32. The plurality of hooks 56 disposed on the bottom edge 30 may be adapted to engage an upper edge 84 of each of the plurality of apertures 58 on the removable bottom trim panel 32 to operably couple the removable bottom trim panel 32 to the bottom edge 30 of the oven assembly 10.

Similarly, in the case of the second embodiment of the removable fastening mechanism 54 described above, the plurality of offset tabs 62 may be oriented upwardly and and may be disposed on the bottom edge 30 of the oven assembly 10, with the corresponding plurality of apertures 58 disposed on the upwardly extending rear longitudinal edge 50 of the removable bottom trim panel 32. The plurality of offset tabs 62 disposed on the bottom edge 30 may be adapted to engage some of the plurality of apertures 58 on the removable bottom trim panel 32 and the upwardly extending hook 56 disposed on the bottom edge 30 may be adapted to engage the upper edge 84 of one of the plurality of apertures 58 on the removable bottom trim panel 32 to operably couple the removable bottom trim panel 32 to the bottom edge 30 of the oven assembly 10

Finally, in the case of the third embodiment of the removable fastening mechanism 54 described above, the plurality of aligned magnets 66 may be arranged at separated intervals along the bottom edge 30 of the oven assembly 10. The removable bottom trim panel 32 may be entirely or partially fabricated from steel or other ferrous material and the flange 40 of the removable bottom trim panel 32 may include the front frame emboss 68 disposed along its longitudinal width. The front frame emboss 68 may also include the first side corner 70 and the second side corner 72, such that one of the plurality of aligned magnets 66 at a first side 86 of the bottom edge 30 is disposed to engage the first side corner 70 and another of the plurality of aligned magnets 66 at an opposite second side 88 of the bottom edge 30 is disposed to engage the second side corner 72. The front frame emboss 68 may further include the longitudinal recess 78 defined by the first side corner 70 and the second side corner 72 and the trough 80 extending between the first side corner 70 and the second side corner 72. The plurality of aligned magnets 66 may be disposed along the bottom edge 30 and may extend into and be received within the longitudinal recess 78 of the removable bottom trim panel 32.

In operation, the removable bottom trim panel 32 may be readily removed for cleaning and subsequently reinstalled without the need for tools or removal of the movable oven door 28. Once the removable bottom trim panel 32 is removed, crumbs and debris that may accumulate in the channel located beneath the movable oven door 28 of the oven assembly 10, when the removable bottom trim panel 32 is installed, may be readily discarded and the removable bottom trim panel 32 may be readily cleaned by rinsing the removable bottom trim panel 32 in a sink and drying it. The removable bottom trim panel 32 may then be readily reinstalled. Due to the removable fastening mechanism 54 described above, the removable bottom trim panel 32 is easy to remove and reinstall even with the movable oven door 28 in place.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An oven assembly comprising:

a cooking chamber having a rear wall, a pair of opposed side walls, a top wall, a bottom wall, and an access opening defined by an outer perimeter of the cooking chamber;

a movable door operably coupled with the oven assembly for selectively enclosing the cooking chamber about the outer perimeter of the cooking chamber;

a removable bottom trim panel disposed proximate a bottom edge of the outer perimeter, the removable bottom trim panel comprising a tray body further comprising a flange being cantilevered with respect to, extending away from and disposed beneath the access opening and movable door; and a removable fastening mechanism disposed on the tray body or the bottom edge and operably coupling the tray body to the bottom edge;

wherein the removable fastening mechanism is adapted to removably attach the removable bottom trim panel to the bottom edge.

2. The oven assembly of claim 1, wherein the removable fastening mechanism comprises a plurality of hooks disposed on the removable bottom trim panel adapted to engage a plurality of apertures disposed on the bottom edge or a plurality of hooks disposed on the bottom edge adapted to engage a plurality of apertures on the removable bottom trim panel.

3. The oven assembly of claim 2, wherein the bottom edge comprises the plurality of apertures horizontally arranged at separated intervals along the bottom edge and the removable fastening mechanism comprises the plurality of hooks arranged at separated intervals along a longitudinal edge of the tray body; and wherein the plurality of apertures horizontally arranged at separated intervals are aligned with the plurality of hooks arranged at separated intervals along the longitudinal edge of the tray body.

4. The oven assembly of claim 1, wherein the removable fastening mechanism comprises a plurality of offset tabs disposed on the removable bottom trim panel adapted to engage a plurality of apertures disposed on the bottom edge or a plurality of offset tabs disposed on the bottom edge adapted to engage a plurality of apertures on the removable bottom trim panel.

5. The oven assembly of claim 4, further comprising a hook disposed on the removable bottom trim panel or the bottom edge.

6. The oven assembly of claim 5, wherein the hook is disposed between the plurality of offset tabs.

7. The oven assembly of claim 1, wherein the bottom edge comprises a plurality of apertures horizontally arranged at separated intervals along the bottom edge and the removable fastening mechanism comprises a plurality of offset tabs arranged at separated intervals along a longitudinal edge of the tray body; and wherein the plurality of apertures horizontally arranged at separated intervals along the bottom edge are aligned with the plurality of offset tabs arranged at separated intervals along the longitudinal edge of the tray body.

8. The oven assembly of claim 7, wherein the removable fastening mechanism further comprises a hook arranged along the longitudinal edge of the tray body and disposed between the plurality of offset tabs; and wherein a one of the plurality of apertures horizontally arranged at separated intervals of the bottom edge aligns with the hook arranged along the longitudinal edge of the tray body.

9. The oven assembly of claim 1, wherein the removable fastening mechanism comprises a plurality of aligned magnets arranged at separated intervals along the flange disposed along a longitudinal edge of the tray body or along the bottom edge.

10. The oven assembly of claim 9, wherein the bottom edge comprises a front frame emboss disposed along the bottom edge and the plurality of magnets are arranged at separated intervals along the flange disposed along a longitudinal edge of the tray body; and wherein the front frame emboss comprises a first side corner and a second side corner and one of the plurality of aligned magnets at a first side of the tray body is disposed to engage the first side corner and another of the plurality of aligned magnets at an opposite second side of the tray body is disposed to engage the second side corner.

11. The oven assembly of claim 10, wherein the front frame emboss comprises a longitudinal recess defined by the first side corner and the second side corner and a trough extending between the first side corner and the second side corner; and wherein the plurality of aligned magnets are disposed upon a bottom side of the flange disposed along the longitudinal edge of the tray body and extend into and are received within the longitudinal recess.

12. The oven assembly of claim 1, wherein the removable fastening mechanism is disposed upon the flange; and wherein the tray body comprises a front wall and a pair of opposed end walls, and the flange further comprises a pair of opposed side walls being received within, and the removable bottom trim panel being located by, a pair of opposed side edges of the outer perimeter of the cooking chamber.

13. A removable bottom trim panel for an oven assembly, wherein a bottom edge of an opening of a cooking chamber of the oven assembly is disposed proximate an oven door, the removable bottom trim panel comprising:

a tray body having a front wall, a pair of opposed end walls, and a flange having a pair of opposed side wall operably coupled with the tray body opposite the front wall, the flange being cantilevered with respect to, extending away from and disposed beneath the access opening and movable door, and parallel with a longitudinal length of the tray body; and a removable fastening mechanism disposed on an interior edge of the flange and adapted to engage the bottom edge or disposed on the bottom edge and adapted to engage the flange.

14. The removable bottom trim panel for an oven assembly of claim 13, wherein the removable fastening mechanism comprises a plurality of hooks disposed on the flange and adapted to engage a plurality of aligned apertures disposed on the bottom edge.

15. The removable bottom trim panel for an oven assembly of claim 13, wherein the removable fastening mechanism further comprises a plurality of offset tabs disposed on the flange and adapted to engage a plurality of aligned apertures disposed on the bottom edge.

16. The removable bottom trim panel for an oven assembly of claim 15, wherein the removable fastening mechanism further comprises a hook disposed between the plurality of offset tabs and adapted to engage a one of the plurality of aligned apertures disposed on the bottom edge.

17. The removable bottom trim panel for an oven assembly of claim 13, wherein the removable fastening mechanism further comprises a plurality of magnets arranged at separated intervals along the flange and adapted to engage the bottom edge.

18. The removable bottom trim panel for an oven assembly of claim 17, wherein the bottom edge further comprises a front frame emboss having a longitudinal recess defined by a first side corner and a second side corner and a trough extending between the first side corner and the second side corner; and wherein the plurality of magnets are disposed upon a bottom side of the flange disposed along a longitudinal edge of the tray body and extend into and are received within the longitudinal recess.

19. An oven assembly comprising:

a cooking chamber having a bottom edge partially defining an opening of the cooking chamber;

a removable bottom trim panel disposed proximate the bottom edge, the bottom trim panel comprising a tray body having a front wall, a pair of opposed end walls, and a flange having a pair of opposed side walls operably coupled with the tray body opposite the front wall, the flange being cantilevered with respect to, extending away from and disposed beneath the access opening and movable door, and parallel with a longitudinal length of the tray body; and a removable fastening mechanism disposed on the flange and adapted to engage the bottom edge of the opening of the cooking chamber.

20. The oven assembly of claim 19, wherein the opening of the cooking chamber further comprises a pair of opposed side edges, and wherein the opposed side walls of the flange of the tray body are received within and the removable bottom trim panel is located by the pair of opposed side edges of the cooking chamber.

* * * * *